United States Patent [19]

Olin

[11] 4,294,295

[45] Oct. 13, 1981

[54] APPARATUS FOR CUTTING AND SPLITTING FIREWOOD

[75] Inventor: C. Howard Olin, Tigard, Oreg.

[73] Assignee: Bloomfield Farms, Inc., Los Altos, Calif.

[21] Appl. No.: 945,464

[22] Filed: Sep. 25, 1978

[51] Int. Cl.[3] ..... B27L 7/00

[52] U.S. Cl. ..... 144/3 K; 83/159; 83/210; 83/377; 83/390; 83/391; 83/453; 83/467 R; 83/471.2; 144/193 A; 269/55

[58] Field of Search ..... 83/157, 158, 159, 160, 83/208, 210, 282, 380, 388, 391, 377, 390, 452, 467, 453, 471.2, 478, 490; 144/3 K, 193 R, 193 A, 312, 326 R; 269/55, 265

[56] References Cited

U.S. PATENT DOCUMENTS

| | | | |
|---|---|---|---|
| 5,901 | 11/1848 | Crousillac . | |
| 265,425 | 4/1882 | Brock . | |
| 675,567 | 6/1901 | Levin . | |
| 1,001,272 | 8/1911 | Howard . | |
| 1,441,996 | 1/1923 | Mukai . | |
| 1,666,795 | 4/1928 | Schmidt . | |
| 2,144,335 | 1/1939 | Jensen et al. | 83/380 |
| 2,876,816 | 3/1959 | Busch et al. . | |
| 3,141,367 | 7/1964 | Keener et al. | 83/282 |
| 3,254,686 | 6/1966 | Boyd et al. . | |
| 3,356,115 | 12/1967 | Cole . | |
| 3,500,882 | 3/1970 | Tanguay . | |
| 3,596,691 | 8/1971 | Broadfoot . | |
| 3,750,727 | 8/1973 | Ord . | |
| 3,763,905 | 10/1973 | Hamilton . | |
| 3,777,603 | 12/1973 | Tracy | 83/282 |
| 3,862,651 | 1/1975 | Heikkinen | 144/3 K |
| 3,920,058 | 11/1975 | Walker . | |
| 3,946,631 | 3/1976 | Malm | 83/380 |
| 3,951,187 | 4/1976 | Chisum . | |
| 3,974,867 | 8/1976 | Butas, Jr. | 144/193 A |
| 4,031,788 | 6/1977 | Boge et al. | 83/380 |
| 4,076,061 | 2/1978 | Greeninger | 144/3 K |
| 4,160,470 | 7/1979 | Sigmund | 144/3 K |

FOREIGN PATENT DOCUMENTS

| | | | |
|---|---|---|---|
| 1028933 | 4/1978 | Canada | 144/193 A |

*Primary Examiner*—W. D. Bray
*Attorney, Agent, or Firm*—Eugene D. Farley

[57] ABSTRACT

The apparatus comprises a wheel-mounted frame on which engine driven hydraulic pumps are mounted to provide hydraulic power. Extending from the side of the frame is a live deck for transporting logs transverse to their length. A longitudinal conveyor receives the logs from the live deck and transports the logs to a retractable stop to establish the length of a firewood block. A saw adapted to transversely cut the log is arranged to be lowered to cut the block from the log. A guard encloses the saw and supports clamps that clamp the log on each side of the saw during cutting. The retractable stop is retracted from the log end as the guard clamps the log for cutting. Following cutting the cut block is directed to a centering device which centers the block relative to a hydraulic actuated ram and fixed splitter blades. The block is split when forced across the splitter blades by the ram. A kicker rejects log remnants to a reject conveyor. Unsuitable blocks are rejected to the reject conveyor.

14 Claims, 38 Drawing Figures

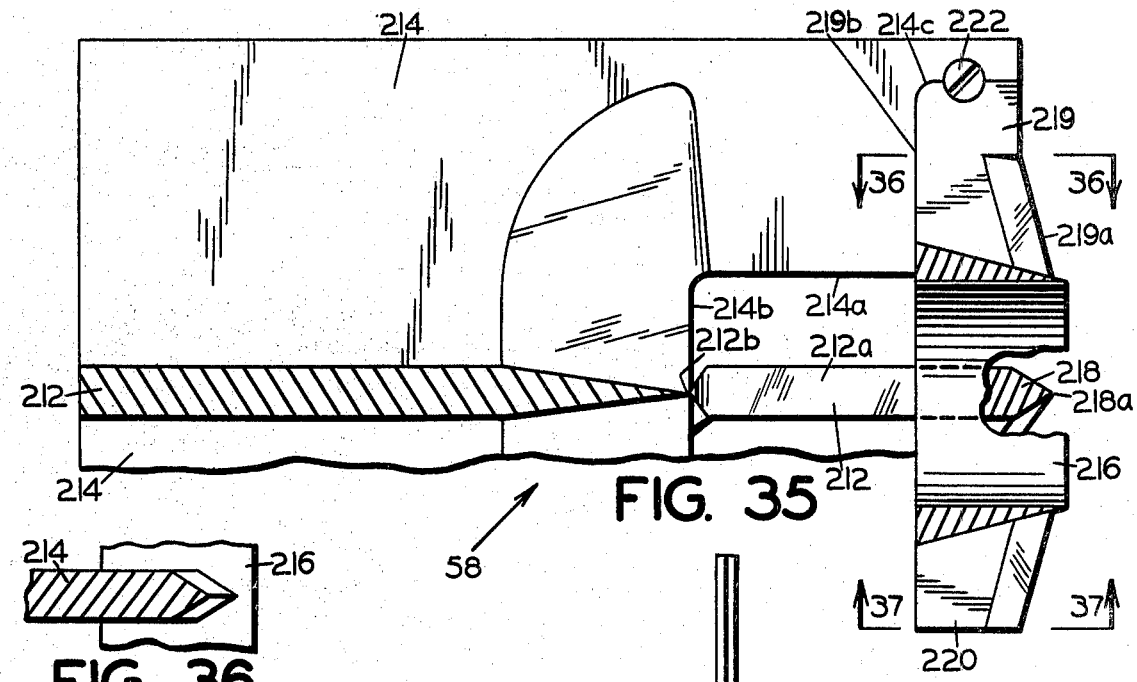
FIG. 35
FIG. 36
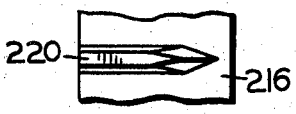
FIG. 37
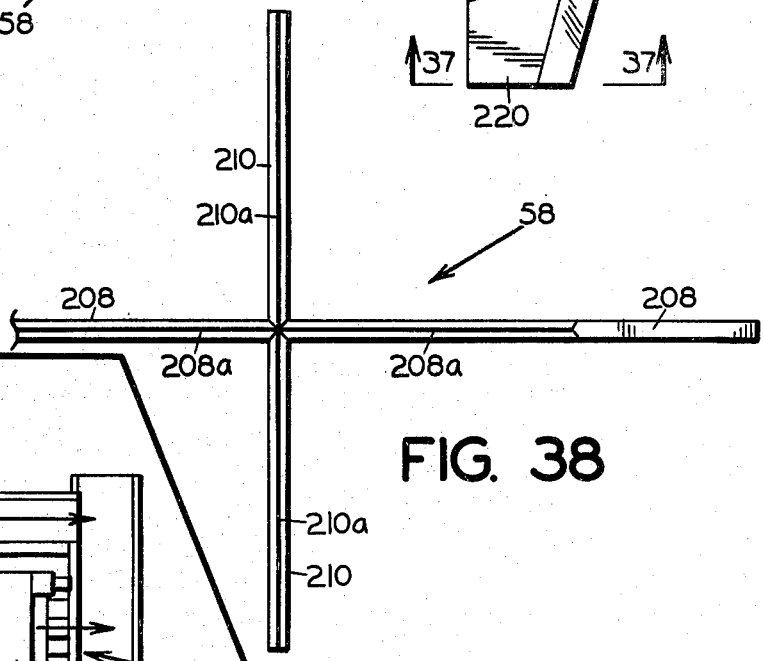
FIG. 38
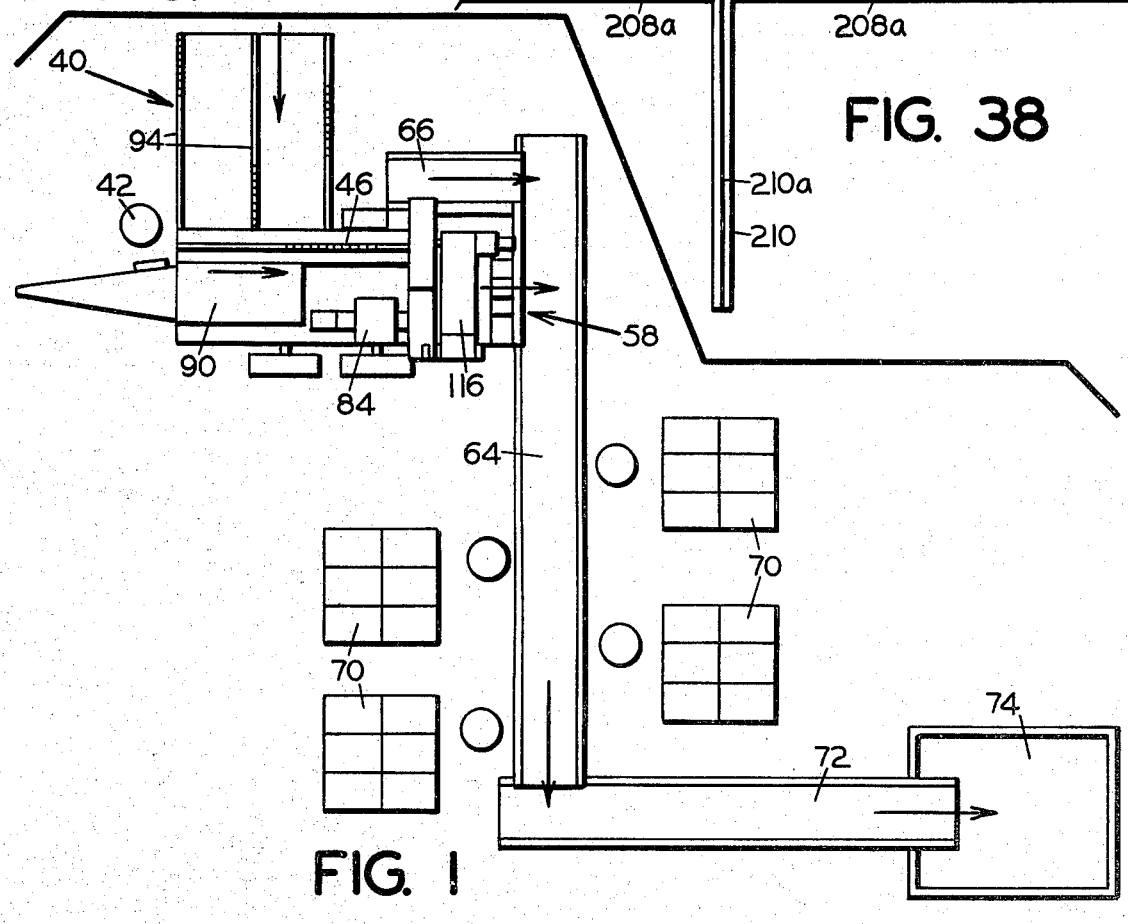
FIG. 1

APPARATUS FOR CUTTING AND SPLITTING FIREWOOD

BACKGROUND AND GENERAL STATEMENT OF THE INVENTION

My invention pertains to apparatus for cutting logs and limbs to a pre-established block length and splitting the blocks into firewood.

In harvesting and processing timber into firewood the harvested timber is normally trimmed of branches and stored as logs to dry. After drying, the logs are cut into firewood length, split and stored. These procedures involve excess and costly handling.

In the interest of economy it is desirable to process the harvested timber into firewood with apparatus capable of being positioned in the harvest area to process the freshly cut timber into firewood, packaged and stored to dry. Such apparatus must be compact and readily portable making it desirable to provide apparatus that combines the cutting and splitting functions in a single assembly. The patent to Mukai, U.S. Pat. No. 1,441,996, discloses a combination cutting and splitting machine. The patent to Crousillac, U.S. Pat. No. 5,901 discloses a multiple saw to produce firewood blocks in combination with a vertical splitting mechanism. The patent to Tanguay, U.S. Pat. No. 3,500,882 discloses transporting logs longitudinally against a fixed stop preparatory to cutting into lengths. The patent to Chisum, U.S. Pat. No. 3,951,187 discloses log handling equipment containing a centering device for centering the log relative to a pre-established center.

It has been found beneficial to provide apparatus that will transport a log longitudinally against a stop, automatically initiating withdrawal of the stop from log and clamping the log on each side of the designated cut before saw cutting a block from the log. Automatic withdrawal of the log from the saw upon completion of the saw cut reduces saw wear and possible binding on the log. Automatic delivery of the block to a splitter station with provision for block rejection by the operator assures quality firewood. Automatic centering of the block relative to fixed splitter blades increases the splitter efficiency and assures uniform firewood sections.

Equipment adapted to be readily portable and to receive bundles of logs for processing into firewood at the site of harvest incorporating the above mentioned features is not currently available. It is the general object of the present invention to provide apparatus adapted to receive logs by machine handling, automatically feed the logs to a cutoff saw, clamp the logs and cut blocks, discharge the blocks into a splitter, center and split the blocks into firewood and convey the firewood to a packaging station, thereby minimizing manual handling.

Another object of the invention is to provide apparatus that will convey the log onto a longitudinal conveyor and automatically feed the log longitudinally against a stop preparatory to cutting.

Another object of the invention is to provide apparatus that will clamp the log on each side of the cutoff point.

Another object of the invention is to provide apparatus having a stop that retracts free of the log before cutting a block.

Another object of the invention is to provide apparatus that will automatically retract the log from the cutoff saw following the cutting operation.

Another object of the invention is to provide apparatus that automatically directs the block into a centering device.

Another object of the invention is to provide apparatus that permits an operator to discharge an undesirable block to a reject conveyor.

Another object of the invention is to provide apparatus that permits the operator to reject the remnant end of the log to a reject conveyor.

Another object of the invention is to provide apparatus that will automatically center the block relative to splitter blades.

Another object of the invention is to provide apparatus that will automatically force the cut block through splitter blades for splitting the block into firewood.

Another object of the invention is to provide apparatus having a conveyor for conveying the split wood to packaging stations.

Another object of the invention is to provide apparatus that will produce esthetically appealing firewood.

Broadly considered, the foregoing and other objects of this invention are accomplished by apparatus which comprises a wheel-mounted frame with a draw tongue attachable to a vehicle. Extending from the side of the frame is a live deck adapted to transport logs transverse to their longitudinal length onto an infeed conveyor. Along one side parallel to the longitudinal axis of the frame is a power-driven longitudinal log conveyor adapted to receive logs from the live deck. The logs are transported longitudinally against a retractable stop which initiates the lowering of a power-driven saw transverse to the frame and longitudinal conveyor. A saw guard enclosing the saw is provided with clamps on each side of the guard which clamp the log on each side of the designated cut before the saw engages the log holding the log for the cutting operation. Upon completion of the cut producing a block, the block is deposited on a block support and the infeed conveyor is reversed, withdrawing the log from contact with the saw as the saw and guard are raised clear of the log and block.

When the saw guard lifts free of the block the block support is tilted permitting the block to fall by gravity into a log centering device which automatically centers the log relative to frame-mounted splitter blades. An hydraulic-actuated ram forces the block past the splitter blades producing firewood that is deposited on a belt conveyor transverse to the longitudinal axis of the frame. The block support is adapted to discharge a reject block to a reject conveyor. A kicker rejects the remnant log end to the reject conveyor following cutting of the last block from a log.

Power for the various functions is supplied by an engine driving fluid, preferably hydraulic, pumps which supply hydraulic power to the hydraulic motors and the hydraulic systems.

BRIEF DESCRIPTION OF THE DRAWINGS

FIG. 1 is a schematic plan view representation of the apparatus and associated packaging stations.

FIG. 35 is a sectional view along the line 35—35 of FIG. 32.

FIG. 36 is a sectional view along the line 36—36 of FIG. 35.

FIG. 37 is a fragmented elevation view along the line 37—37 of FIG. 35.

FIG. 38 is an end elevation view of an alternate splitter blade assembly.

DESCRIPTION OF THE APPARATUS

Functional Description

Figure 2:
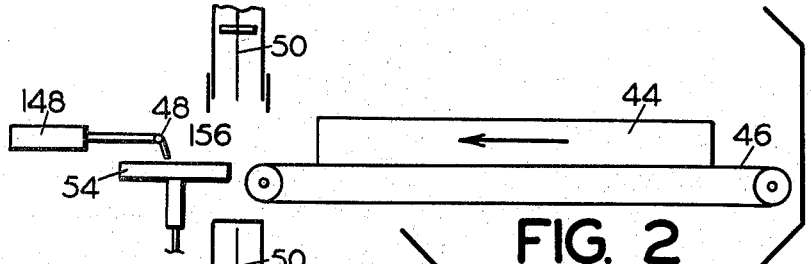
FIGS. 2 through 11 are schematic representations of the functions performed by the apparatus.
Figure 3:
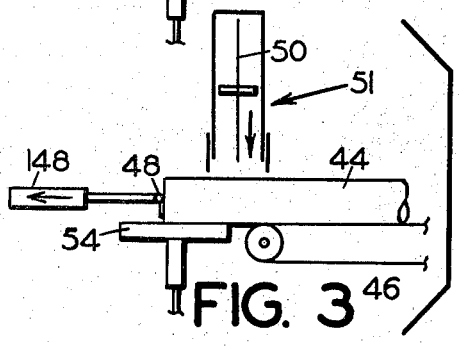
Figure 4:
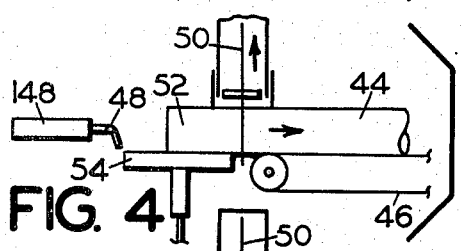

The functions are schematically illustrated in FIGS. 1 through 11.

A bundle or group of logs is placed on the live deck 40, FIG. 1 which is controlled by the operator at the control station 42. The live deck 40 transports a log 44 onto the infeed conveyor 46, FIGS. 1 and 2, which transports the log 44 longitudinally into contact with the retractable stop 48. Contact with the stop 48 stops the infeed conveyor 46 and initiates retraction of the stop 48 from the end of the log, FIG. 4, the lowering of the saw 50, and clamping of the log 44 by the saw guard 51.

Figure 5:
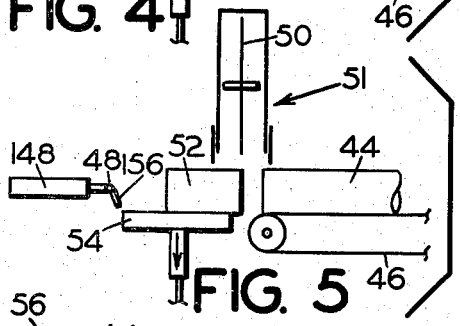

Upon completion of the saw cut depositing block 52 on block support 54, the log 44 is withdrawn from contact with the saw 50 by reversal of the conveyor 46 and the saw 50 returned to its raised position, FIG. 5.

Figure 6:
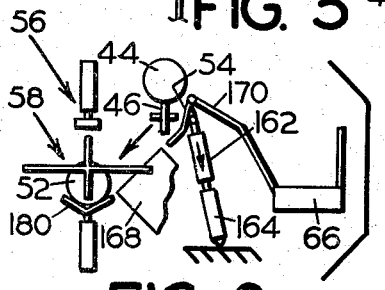

The block support 54 is tilted to permit the block 52 to roll by gravity into centering device 56, FIG. 6. The block is then centered by the centering device 56 relative to the splitter blade assembly 58, FIG. 8.

Figure 9:
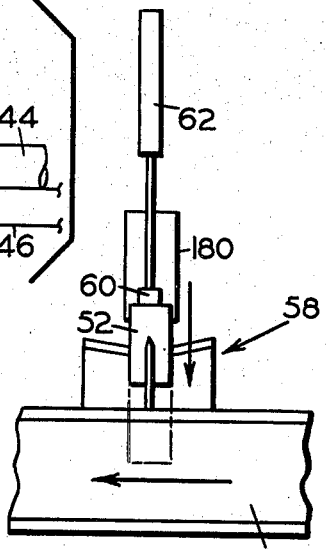
Figure 10:
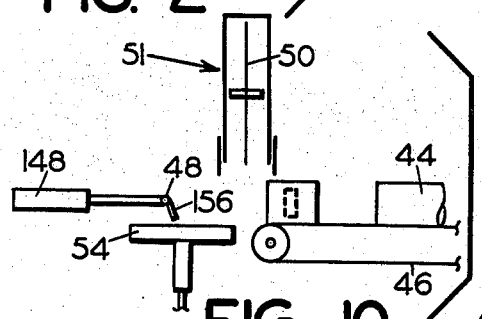
Figure 11:
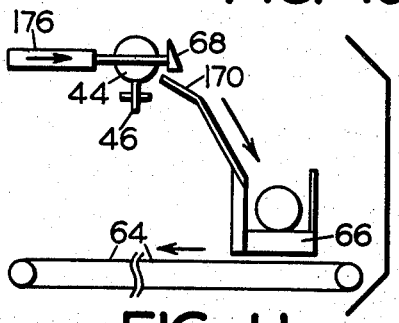

The hydraulic ram 60 actuated by hydraulic cylinder 62 forces the block 52 through the splitter blade assembly 58, FIG. 9, and onto belt conveyor 64.

Figure 7:
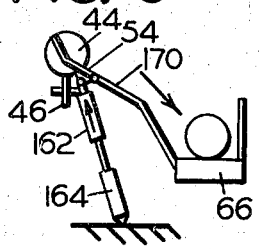
Figure 8:
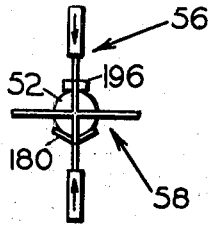

Should the block 52 be undesirable for splitting into acceptable firewood the block support 54 is tilted to raise the block 52 to a position, FIG. 7, causing the block to drop by gravity onto reject conveyor 66. Should the remnant length of the log 44, FIG. 10, be insufficient to produce acceptable firewood, the log remnant is discharged onto the reject conveyor 66, FIG. 11, by kicker assembly 68.

The acceptable firewood together with the reject blocks are conveyed on the conveyor 64, FIG. 1, to packaging stations 70 where acceptable firewood is packaged for storage and shipment with the rejected materials transported onto elevator conveyor 72 and into reject box 74.

Cutoff Assembly

Figure 12:
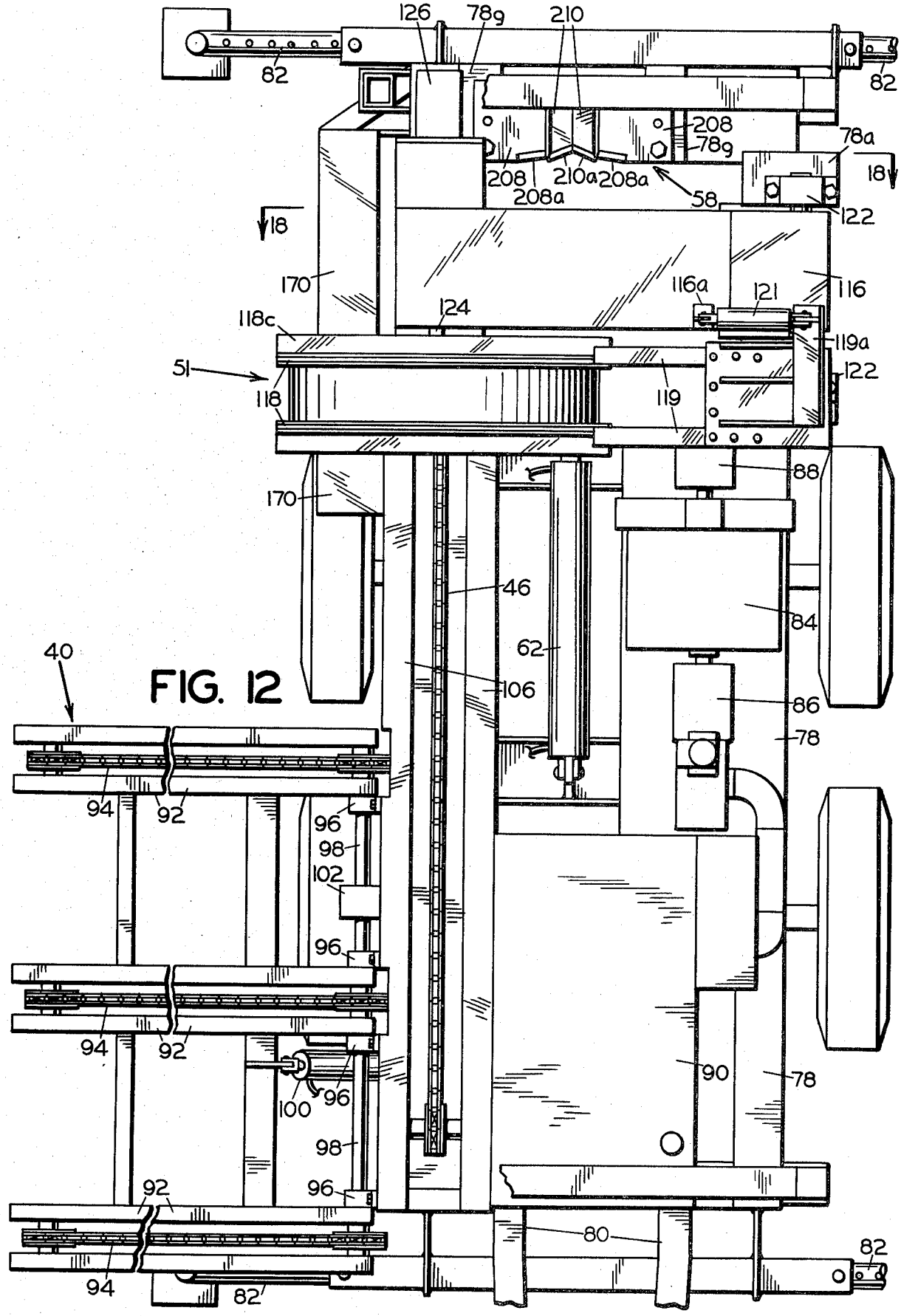
FIG. 12 is a plan view of the apparatus.
Figure 13:
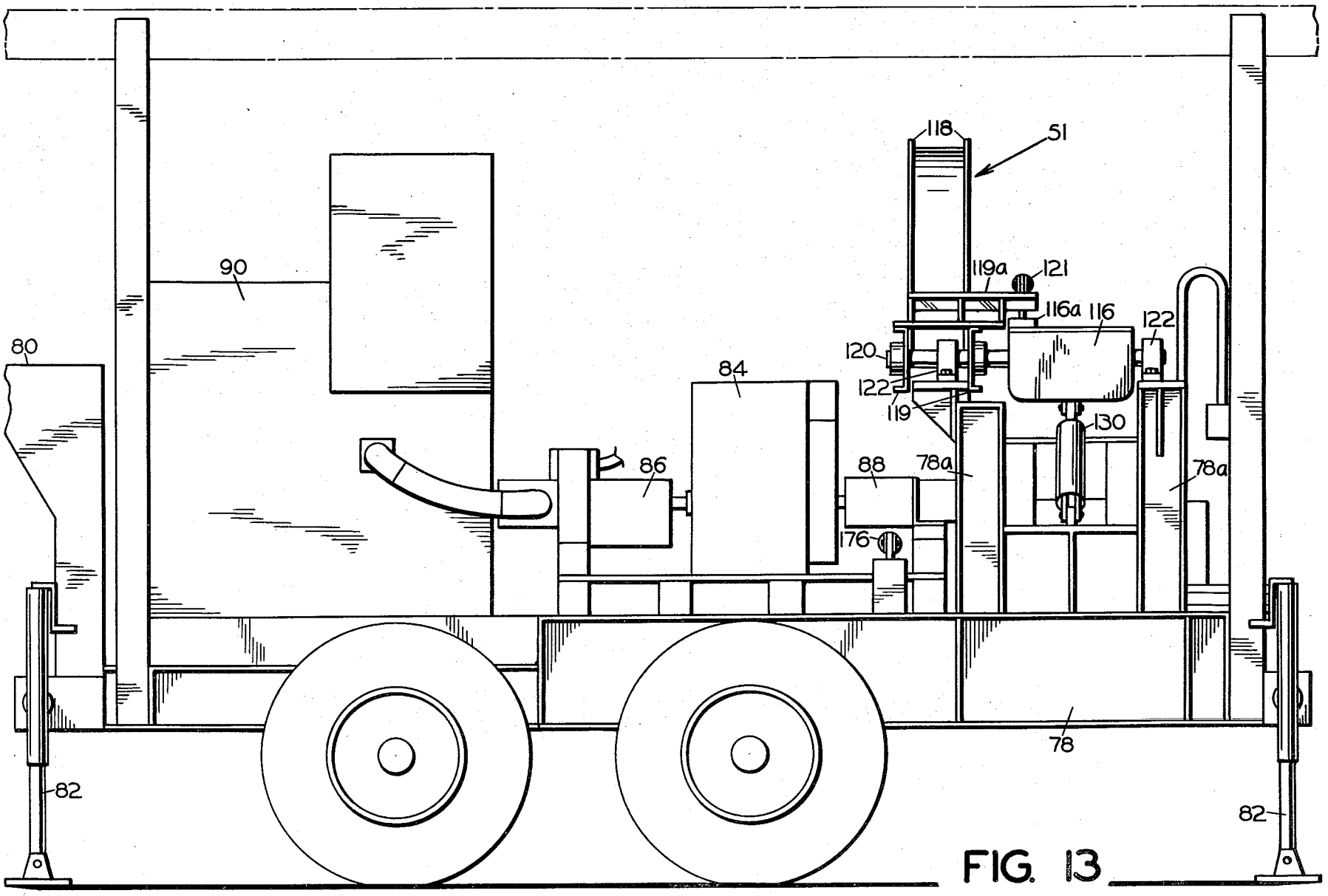
FIG. 13 is a side elevation view of the apparatus.

The self-contained, semi-automatic firewood cutting and splitting apparatus is mounted on a wheel-supported frame 78, FIGS. 12 and 13, provided with a draw tongue 80 adapted to be connected to a vehicle. The frame is stabilized for operation by stabilizing jacks 82.

Mounted along one side of the frame is a power unit comprising an engine 84 driving a fluid double pump 86 and a fluid single pump 88 which furnish fluid power, preferably hydraulic, to the operating functions of the apparatus. Hydraulic fluid for the pumps is supplied from a reservoir 90 mounted near the forward end of the frame.

Extending from the side of the frame opposite the engine 84 is a live deck 40 comprising frame members 92 supporting powered conveyor chains 94. The deck is pivotally supported from the frame 78 on bearings 96 through which the conveyor drive shaft 98 rotates to drive the conveyors 94.

The entire deck 40 is raised and lowered by an hydraulic cylinder assembly 100 permitting the deck to be elevated to a vertical position during transportation of the apparatus. The conveyor chains 94 are driven through the shaft 98 by the hydraulic motor 102. In the lowered or extended position the deck frames 92 are supported by support legs 104, FIG. 14.

Figure 15:
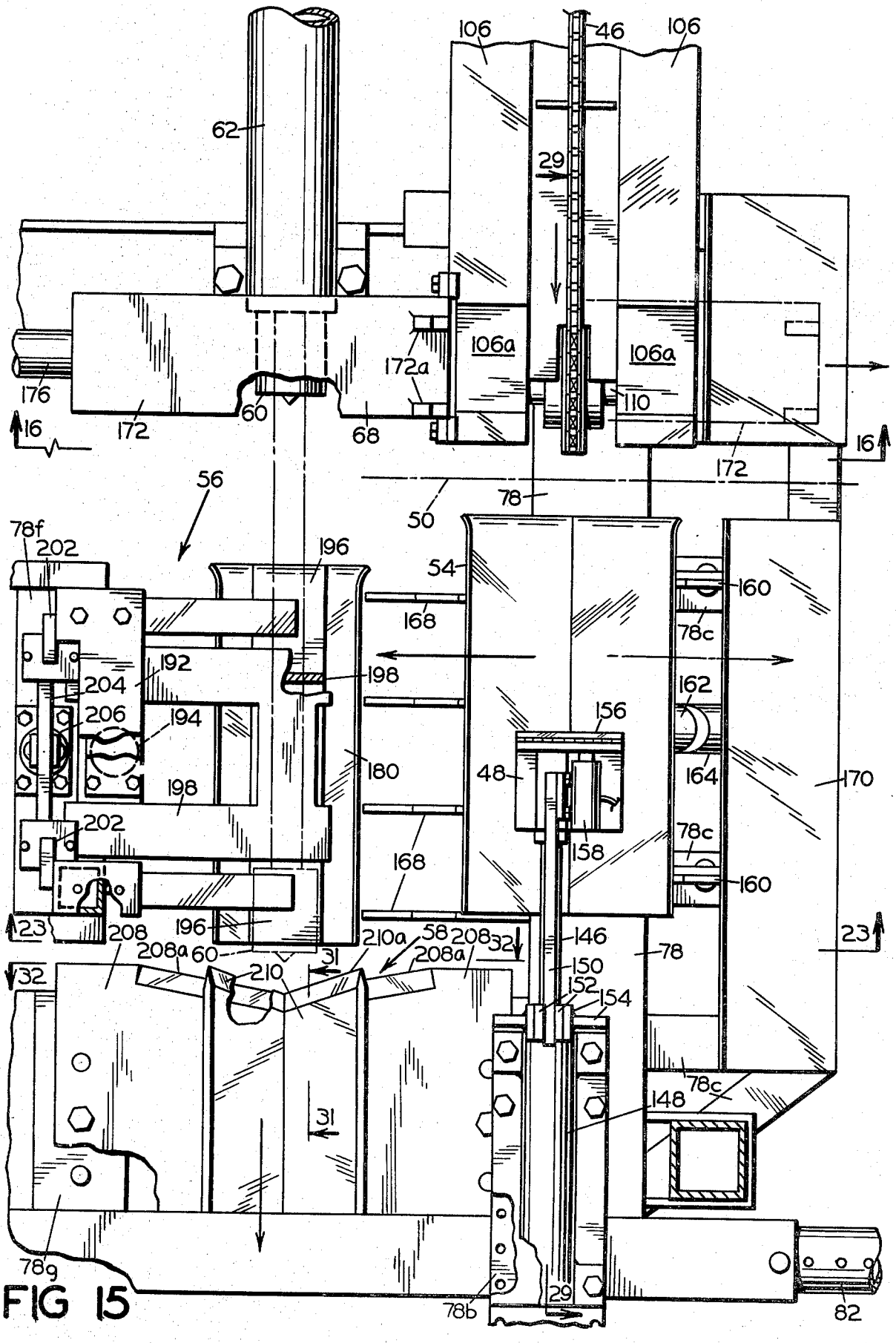
FIG. 15 is an enlarged plan view of the discharge end of the apparatus.
Figure 16:
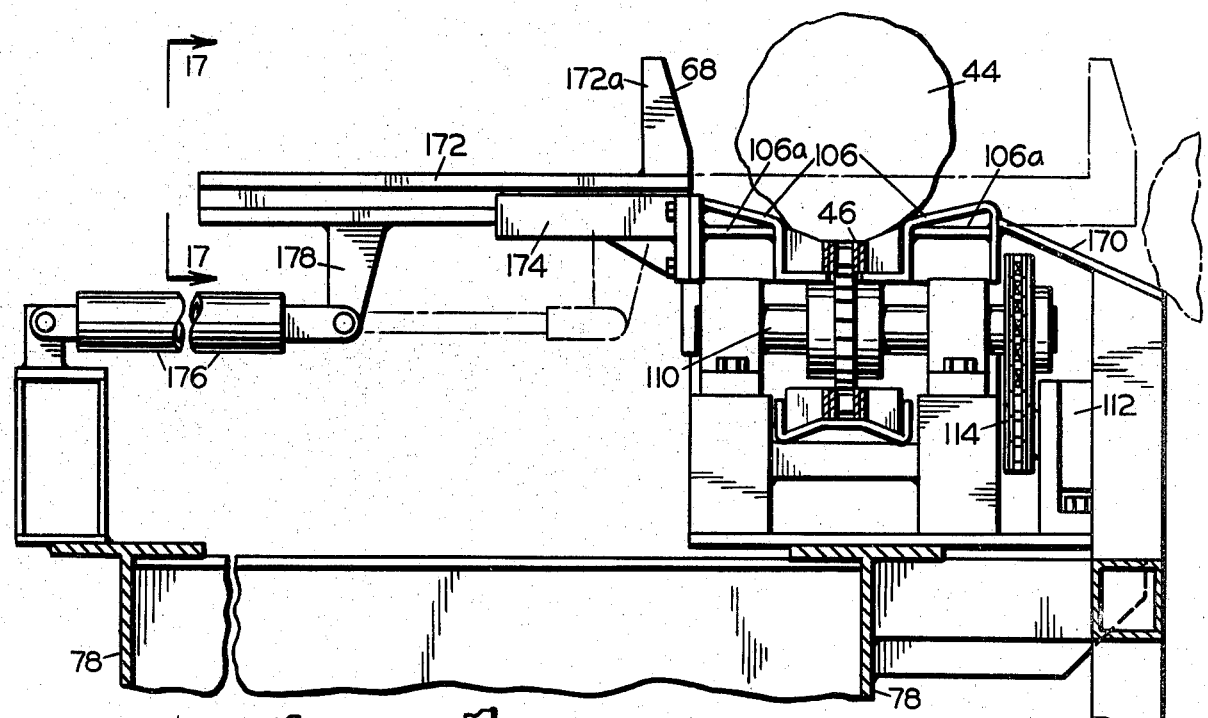
FIG. 16 is a sectional view along the line 16—16 of FIG. 15.
Figure 17:
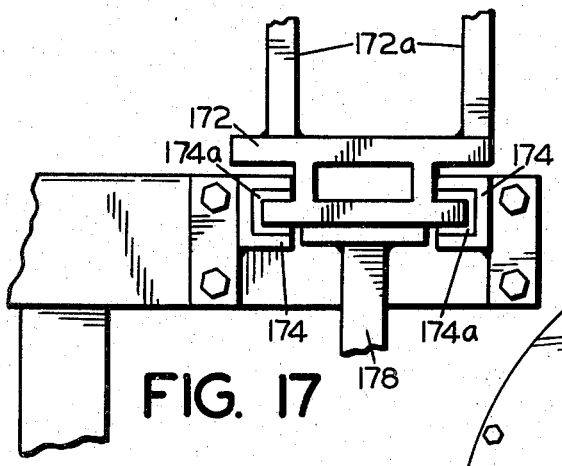
FIG. 17 is an end elevation view along the line 17—17 of FIG. 16.

Extending longitudinally along the side of the frame 78 is a shallow "v" channel 106, FIGS. 12, 15 and 16. Positioned within the channel is an infeed conveyor 46 adapted to receive the logs from the live deck 40 and transport them longitudinally along the shallow "v" channel 106. The infeed conveyor 46 is driven by shaft 110 powered by hydraulic motor 112 through the drive chain 114.

Mounted transverse to the infeed conveyor 46 is cutoff saw 50 supported on saw ladder 116. The saw is enclosed in saw guard 51 provided with side members 118. The saw guard 51 provided with mounting arm 119 and the saw ladder 116 are pivotally supported on shaft 120 mounted in bearing blocks 122 on the upward extending frame member 78*a*. The saw ladder 116 and saw guard 51 are restrained against relative rotation on shaft 120 by hydraulic cylinder assembly 121 pivotally mounted between brackets 116*a* and 119*a*. The saw ladder 116 supports the saw shaft 124 and its associated hydraulic drive motor 126, FIG. 19.

Figure 18:
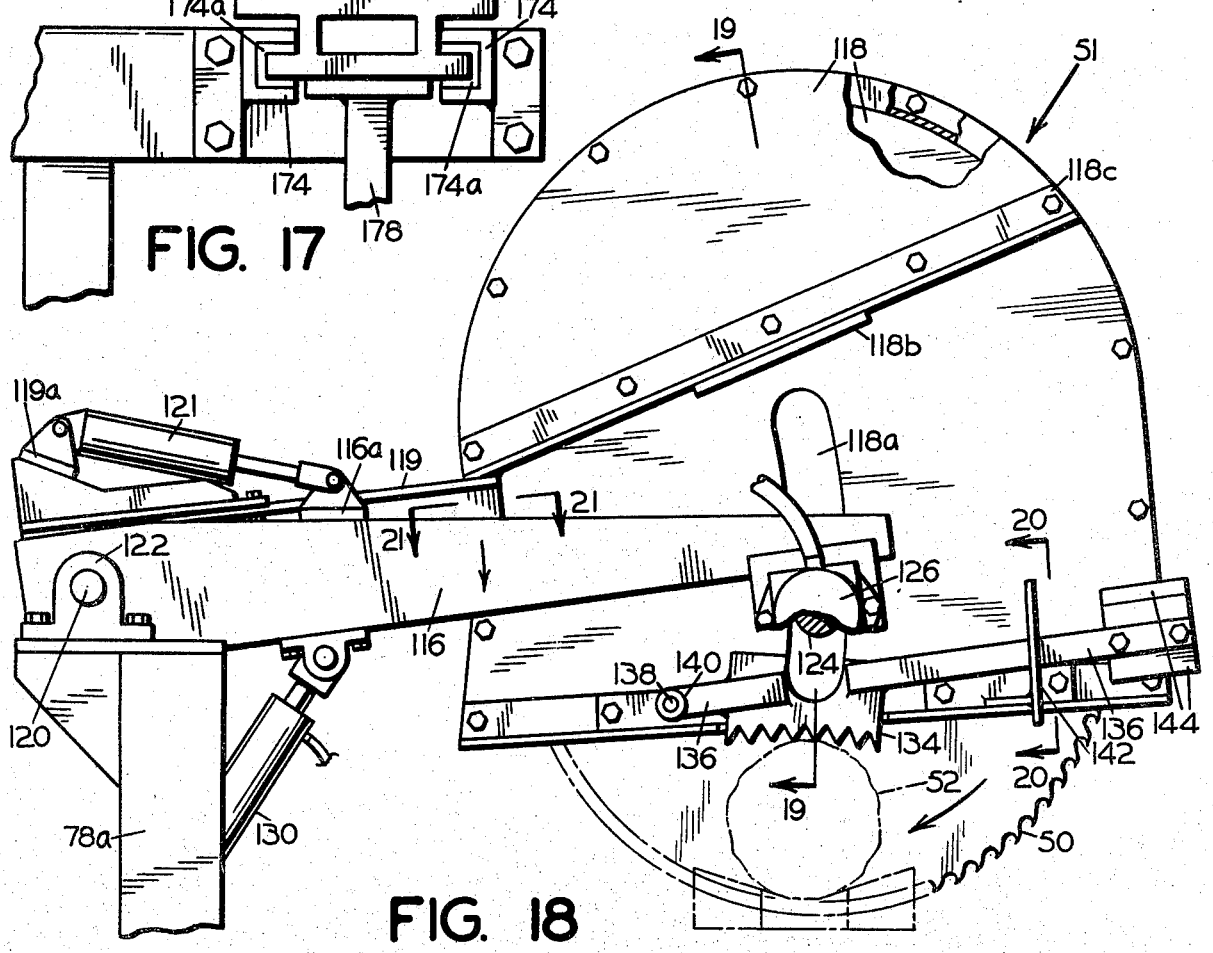
FIG. 18 is a side elevation view of the saw assembly along the line 18—18 of FIG. 12.

The saw shaft 124 is mounted in bearings 128 and extends through the saw guard slotted opening 118*a* in side member 118 to support and drive the saw 50. The saw ladder 116 is raised and lowered by hydraulic cylinder assembly 130, FIG. 18. The saw guard 51 is raised to its uppermost position by contact of resilient pad 118*b*, mounted on side member angle 118*c*, with the upper surface of the ladder 116.

Figures 19, 20, 21, 22:
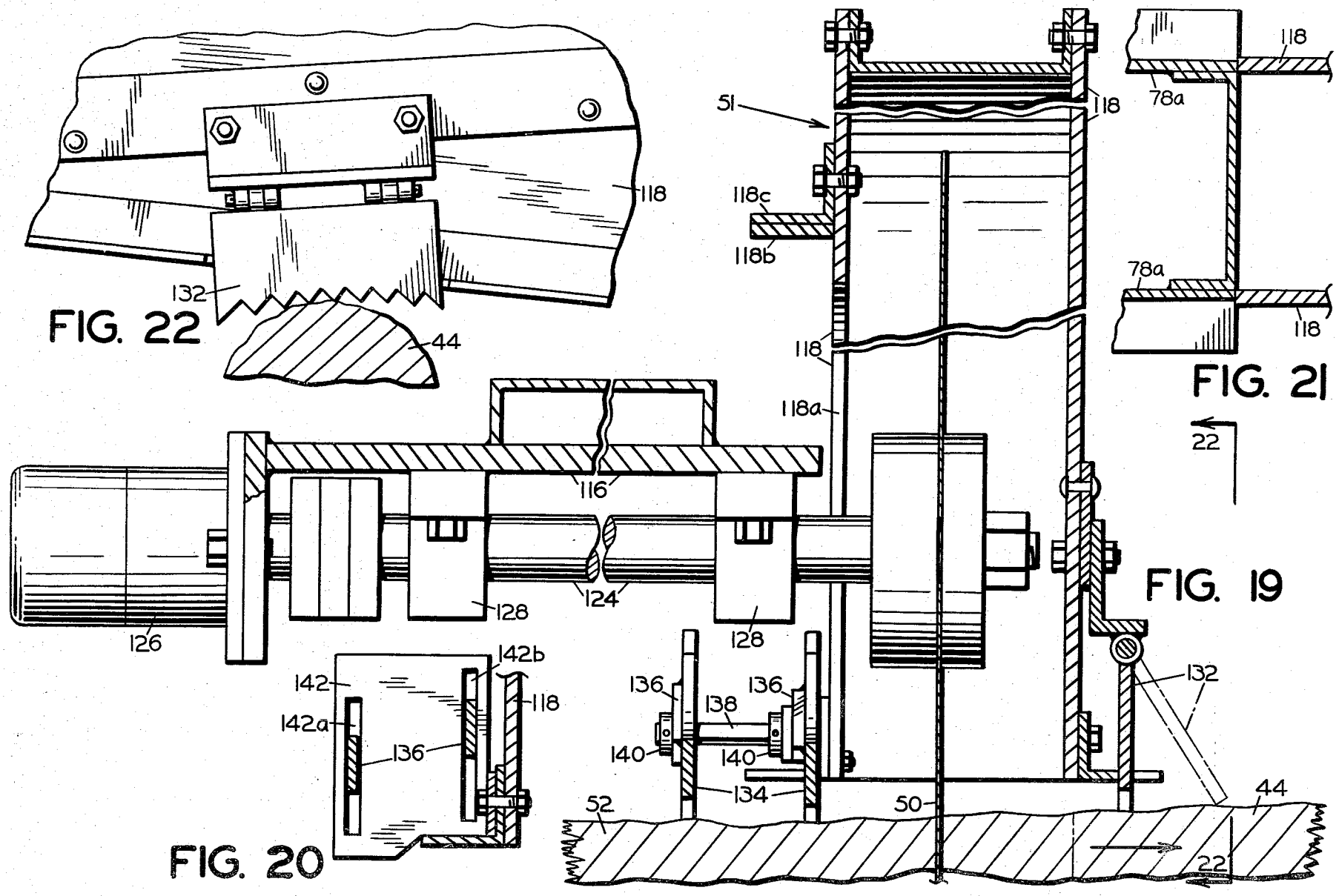
FIG. 19 is a sectional view along the line 19—19 of FIG. 18.
FIG. 20 is a sectional elevation view along the line 20—20 of FIG. 18.
FIG. 21 is a sectional view along the line 21—21 of FIG. 18.
FIG. 22 is a side elevation view along the line 22—22 of FIG. 19.

Mounted on the side of the saw guard 51 side member 118 adjacent the infeed conveyor is a hinged log clamp 132 which establishes the position of the saw guard relative to the log 44, FIG. 19. Mounted on the opposite side member 118 of the saw guard 51 is a pair of gravity-actuated, pivotally mounted log clamps 134, FIGS. 18 and 19. The log clamps 134 are supported on arms 136 pivotally mounted on shaft 138 and retained in position by collars 140.

The weighted ends of the arms 136 extend through a guide plate 142, FIG. 20, provided with slots 142*a* and 142*b* to guide the arms of the respective clamps. Clamping force is provided by the weights 144 attached to the arms 136. The clamps 134 clamp the end of the log 44 to be cut off as block 52.

The hinge log clamp 132 provides for withdrawal of the log 44 from the saw upon completion of the cut, before raising the saw, by reversing the infeed conveyor 46 as indicated by dotted lines in FIG. 19.

Figures 29, 30, 31, 32, 33, 34:
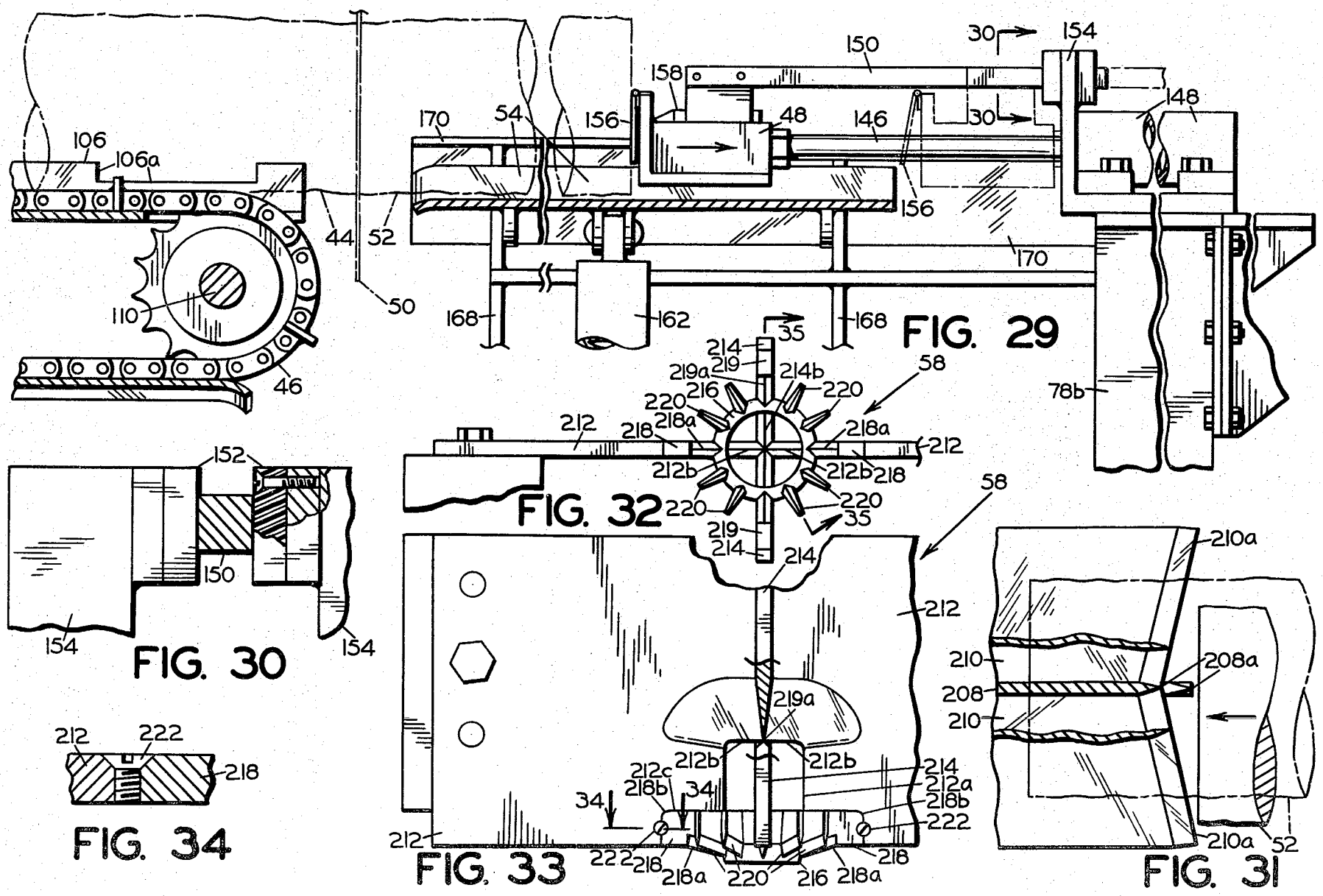
FIG. 29 is a side elevation view along the line 29—29 of FIG. 15.
FIG. 30 is a fragmented sectional view along the line 30—30 of FIG. 29.
FIG. 31 is a sectional view along the line 31—31 of FIG. 15.
FIG. 32 is an end elevation view of an alternate splitter blade assembly along the line 32—32 of FIG. 15.
FIG. 33 is a plan view of FIG. 32.
FIG. 34 is a sectional view along the line 34—34 of FIG. 33.

Positioned in line with the longitudinal conveyor 46 and above its extended upper surface is a retractable log stop 48, FIGS. 15 and 29.

Log stop 48 is mounted on the piston rod 146 of hydraulic cylinder 148. It is prevented from rotating by anti-rotation guide 150. Guide 150 slides between anti-friction surfaces 152, FIG. 30, supported by the outwardly extending bracket 154 on which hydraulic cylinder 148 is mounted and supported on frame member 78*b*.

Mounted on the face of the log stop 48 is a hinged plate 156, FIG. 29, which is engaged by the log 44 as it is moved into contact with the stop 48. The plate 156 actuates switch 158, FIG. 15, that initiates the functions of stopping the infeed conveyor 46 retracting the stop 48 and lowering the saw 50 and saw guard 51, to clamp the log before starting the saw cut.

Figure 23:
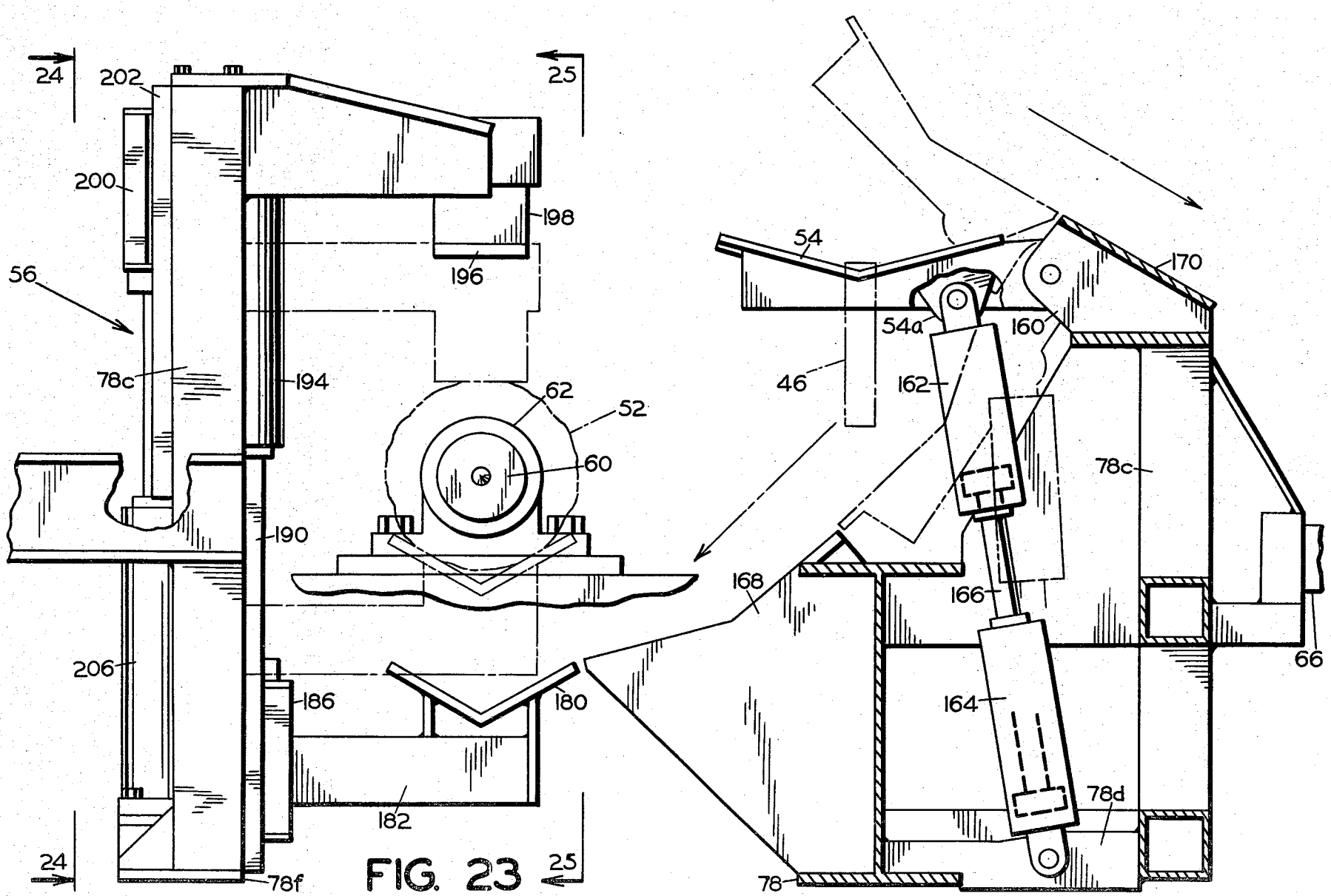
FIG. 23 is a sectional view along the line 23—23 of FIG. 15.
Figure 24:
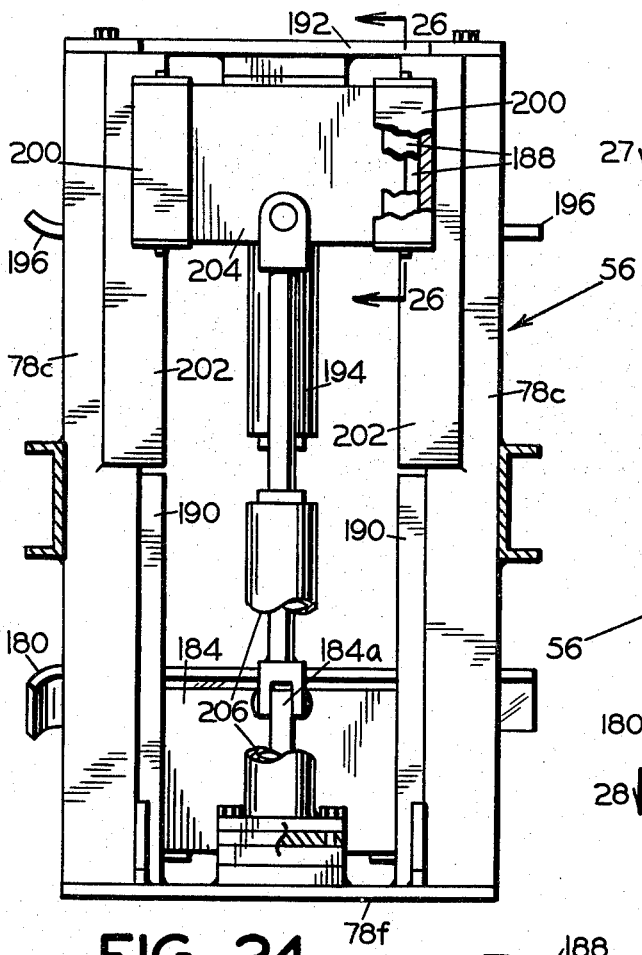
FIG. 24 is a side elevation view along the line 24—24 of FIG. 23.

Positioned between the infeed conveyor 46 and the frame member 78*b* that supports the retractable log stop 48 is a shallow "v" block support 54, FIGS. 15 and 23, aligned with the upper surface of the conveyor 46. The block support 54 is pivotally mounted along one edge on brackets 160 secured to upward extending frame members 78*c*.

The pivoted block support 54 is maintained in angular position by two axially aligned hydraulic cylinders 162 and 164 having a common piston rod 166. Cylinder 162 is pivotally attached to support plate bracket 54 through mounting ear 54*a*. Cylinder 164 is pivotally attached to frame 78*d*. The block support 54 is held in its normal position in alignment with the conveyor 46 when the piston end of the cylinder 162 is pressurized and the piston rod end of cylinder 164 is pressurized, FIG. 23. Release of the pressure in the piston end of the cylinder 162 and pressurizing the piston rod end draws the cylinder 162 downward, lowering the block support 54 to the position shown by broken lines, and permitting the block to fall by gravity to the skids 168, as indicated by the lower arrow, FIG. 23.

With the block support 54 in its normal position, releasing the pressure in the piston rod end of cylinder 164 and pressurizing the piston end raises the block support 54 to the elevated position shown by the upper broken lines in FIG. 23 causing the block to be rejected by gravity across skid plate 170.

Mounted transversely to the infeed conveyor 46 adjacent the saw guard 51 is a kicker assembly 68, FIGS. 15 and 16.

The kicker is comprised of slideable member 172 supported by ways 174 provided with anti-friction surfaces 174*a* adapted to engage the log contacting members (kicker arms ) 172*a*. Arms 172*a* extend above and from the member 172.

The slideable member 172 is adapted to extend across the "v" channel 106 through notches 106*a*, FIG. 29 to engage and reject the log remnant following the final saw cut for that particular log. The kicker 68 is actuated by hydraulic cylinder assembly 176 attached to arm 178 extending from the member 172.

Block Splitting Assembly

The block splitting assembly is horizontally spaced from the longitudinal axis of the infeed conveyor 46 and centered at a lower elevation than the conveyor 46, FIGS. 15 and 23.

Figure 28:
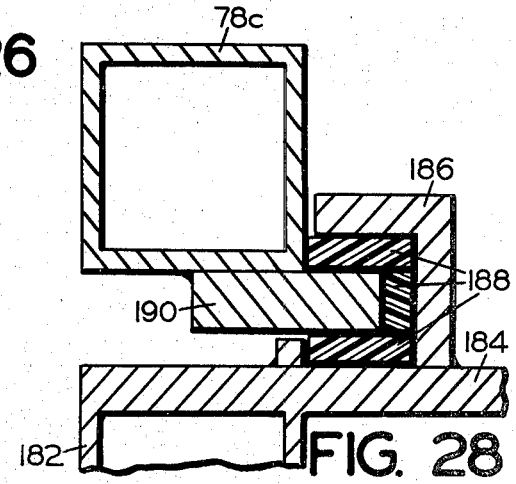
FIG. 28 is a sectional view along the line 28—28 of FIG. 25.

The block discharged from the block support 54 rolls by gravity across block skids 168 and into the "v"-shaped lower centering pan 180 of the block centering device 56, FIG. 23. The centering pan 180 is supported on arms 182 extending from plate 184, FIG. 25 and 28.

Extending from plate 184 are guideways 186 containing anti-friction surfaces 188 adapted to engage the vertical bars 190 attached to the vertical frame members 78*c*. The upper ends of the frame members 78*c* are joined by a cross member 192. A cylinder assembly 194 connects between the cross member 192 and bracket 184*a* attached to plate 184 adapted to raise and lower centering pan 180.

Figure 25:
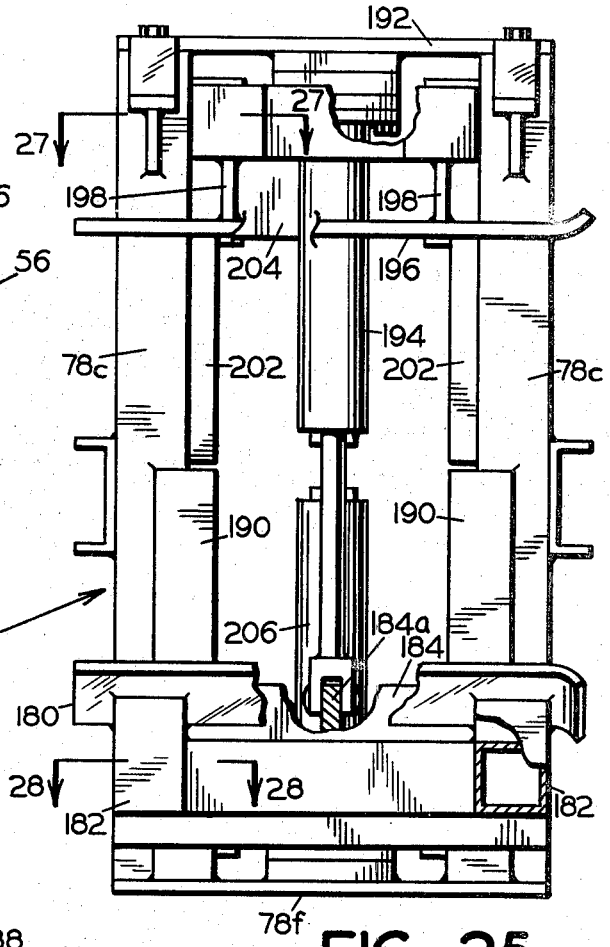
FIG. 25 is a side elevation view along the line 25—25 of FIG. 23.
Figure 26:
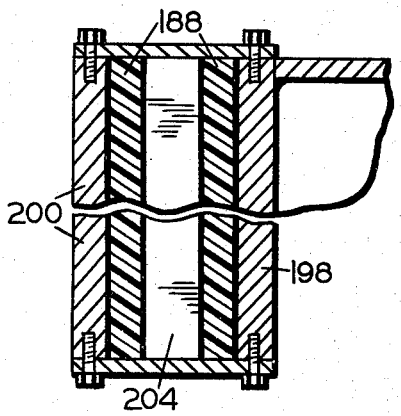
FIG. 26 is a sectional view along the line 26—26 of FIG. 24.
Figure 27:
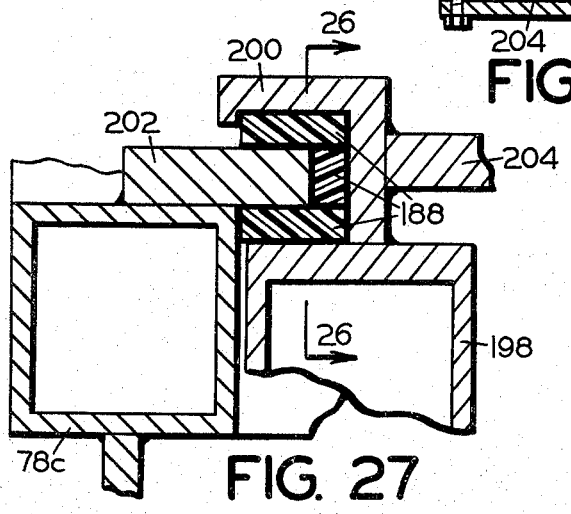
FIG. 27 is a sectional view along the line 27—27 of FIG. 25.

Similarly an upper centering pan 196 is supported by arms 198 FIGS. 23 and 25. Attached to the arms 198 are guideways 200 provided with anti-friction guide surfaces 188 and adapted to slide on guides 202 secured to the back or outboard side of the vertical frame members 78*c*. The guideways 200 are joined by connecting plate 204.

Positioned between the frame member 78*f* and connecting plate 204 is hydraulic cylinder assembly 206 adapted to lower and raise the upper centering pan 196. The lower centering pan 180 receives the block 52 from the support 54 and functions in combination with the upper centering pan 196 to center the block to the splitter blade assembly 58 and the ram 60.

This centering is accomplished by supplying hydraulic pressure to the cylinders 194 and 206 through a flow divider (not shown) that automatically meters identical quantities of fluid to each of the cylinders thereby raising the lower centering pan 180 and lowering the upper centering pan 196 simultaneously so that when the upper centering pan 196 contacts the block 52 it will be centered to the splitter blade assembly 58.

The splitter blade assembly 58, FIGS. 15 and 31, comprises central mounting blades 208 with integral angular blades 210. The cutting edges 208*a*, 210*a* of the splitter blades 208 and 210 are arranged to form an inverted cone, FIG. 31, to assist in centering the block 52 on the blades should the block strike the blades off center.

The splitter blades may be arranged in a combination of four as shown in FIG. 38, or of six as shown in FIGS.

14, 15 and 31. The mounting blade 208 is removably attached to vertical frame members 78g FIGS. 14 and 15 by bolts and dowels.

Mounted in axial alignment with splitter blade assembly 58 is the hydraulic ram cylinder 62 provided with a piston rod terminating in ram 60, FIG. 15, adapted to engage the block 52 and force it into and through the splitter blade assembly 58.

A kindling splitter blade assembly 58 is shown in FIGS. 32 and 35.

The kindling splitter blade assembly has a central mounting blade 212 provided with an irregular opening 212*a* extending inwardly from its leading edge. The cutting or splitting edges 212*b* of the mounting blade 212 are formed from the closed end of opening 212*a*. A vertical splitter mounting blade 214, that is integral with blade 212 also is provided with an opening 214*a* extending inward from the leading edge of the mounting blade 212. The cutting or splitting edges 214*b* of the blade 214 are formed from the closed end of opening 214*a*. Vertical splitter blade 214 has its cutting edge 214*b* aligned with the cutting edge 212*b* of mounting blade 212. Near the leading edges of the mounting blades 212, 214 are shallow notches 212*c*, 214*c*, respectively, extending beyond the sides of openings 212*a*, 214*a*, respectively.

Positioned within the openings 212*c*, 214*c* is a primary splitter blade assembly comprising a cylindrical blade 216 mounted between a pair of horizontal base blades 218 and vertical blades 219, respectively, and provided with tapered cutting edges 218*a*, 219*a*, and trailing edges 218*b*, 219*b*, respectively, contoured to correspond with openings 212*c*, 214*c*, respectively.

A plurality of splitter blades 220 is mounted on the cylindrical blade 216 and extend with their trailing edge towards the blade edges 212*b*, 214*b* of the mounting blades 212, 214. The base blades 218, 219 are retained in openings 212*c*, 214*c* flush with both surfaces of the mounting blades 212, 214 by counter-sunk screws 222 having their centers on the joint line between the sides of the openings 212*c*, 214*c* and the base blades 218, 219 as shown in FIGS. 34, 35. This mounting arrangement permits removal of the primary splitter assembly for independent sharpening of the multiplicity of splitter blades included in this assembly.

In the kindling splitter assembly the block 52 to be split upon contacting the circular blade 216 forms a cylindrical core from its center with the periphery section of the block engaging the splitter blades 218, 219 and 220 splitting the periphery into a multiplicity of kindling pieces. As the core progresses through the cylindrical blade 216 it engages the splitter blades 212 and 214 splitting the core into four kindling sections.

Power Source

Hydraulic fluid under pressure is supplied to the various motors and cylinder assemblies by the engine-driven hydraulic pumps 86 and 88. The pump 86 is a double pump that supplies the hydraulic fluid to the saw motor 126 and the ram cylinder 62. A high volume of fluid is supplied at low pressure until load requirements demand a higher pressure at which time the double pump transfers to lower volume and higher pressure. All other hydraulic functions of the apparatus are supplied hydraulic fluid from the hydraulic pump 88. The control of the flow of hydraulic fluid to the functional cmponents is by solenoid-actuated valves controlled by the automatic sequencing of the electrical system or manually from the control station 42, FIG. 1.

OPERATION

Figure 14:
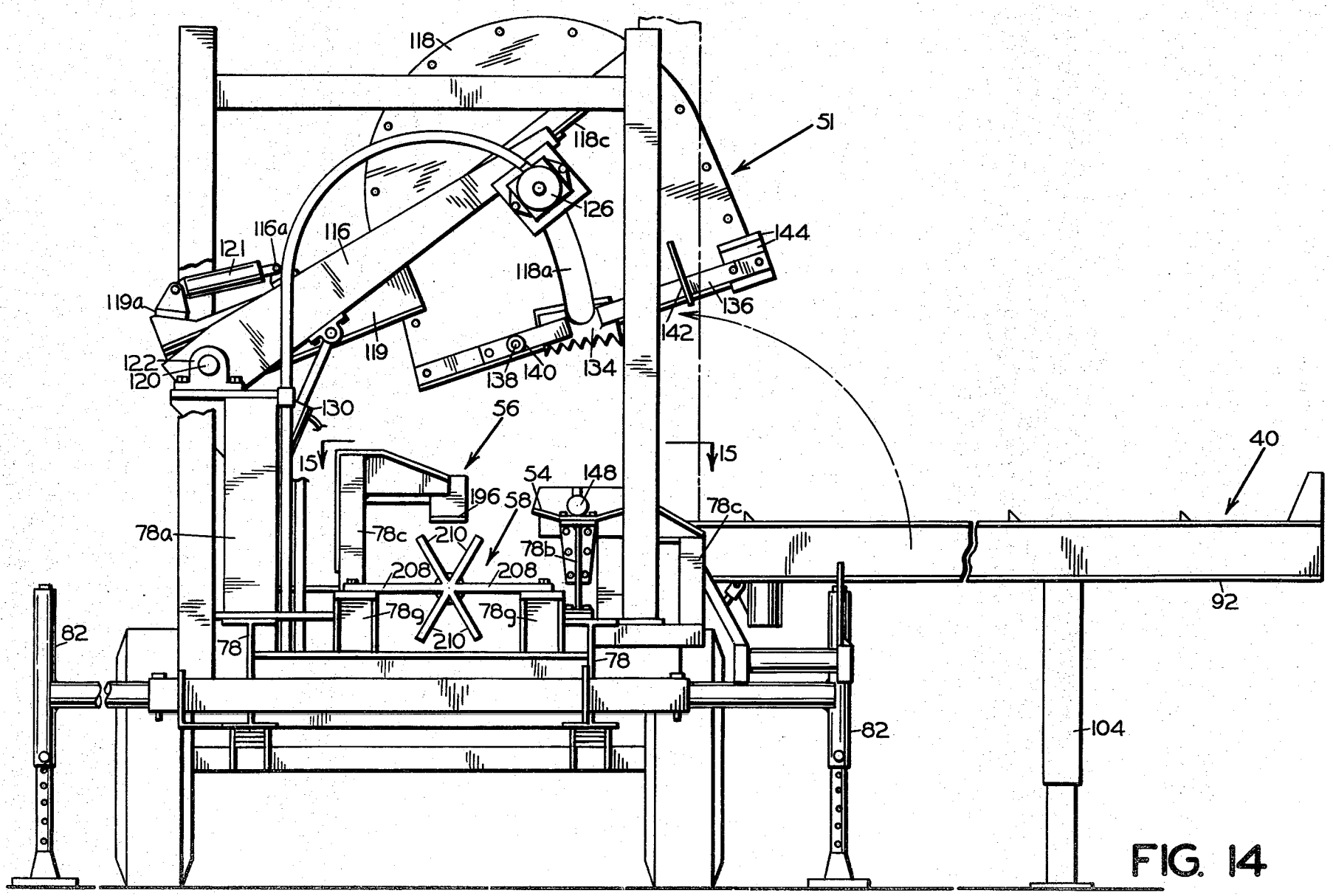
FIG. 14 is an end elevation view of the discharge end of the apparatus.

During transporting of the apparatus to the operating site the stabilizing jacks 82 are elevated and moved inward against the frame of the apparatus. The live deck 40, FIG. 14, is elevated to a vertical position indicated by dotted lines by means of the cylinder assembly 100, FIG. 12. Upon reaching the operating site the stabilizing jack arms are extended and the stabilizing jacks 82 lowered to contact the ground. The live deck 40 is then lowered into position by cylinder assembly 100 and the jacks 104 adjusted to maintain the deck in a level attitude.

With the engine 84 driving the hydraulic pumps 86 and 88 logs are placed on the live deck 40 by means of log handling equipment. The operator at control station 42 places the apparatus in operating mode by actuating the automatic cycle button. This starts the operation of the infeed conveyor 46 and places the log stop 48 in the extended position to establish the length of the block 52 to be cut. The operator then manually energizes the live deck conveyor 94 transporting one of the logs from the live deck onto the longitudinal conveyor 46. The infeed conveyor 46 transports the log longitudinally against log stop 48 causing hinge plate 156 to close switch 158 stopping infeed conveyor 46 and retracting the log stop 48. Simultaneously hydraulic fluid is supplied to the saw motor 126 as the hydraulic cylinder 130 lowers the saw ladder 116 and the saw guard 51 toward the log to be cut.

The rate of lowering of the saw ladder 116 toward the log 44 is controlled by the rate of release of hydraulic fluid from the cylinder end of hydraulic cylinder 130. Upon contact of the clamp 132 on saw guard 51 with the log the rate of continued lowering of saw ladder is controlled by the rate of release of hydraulic fluid from the piston rod end of cylinder assembly 121. The back pressure resulting from the rate of release from cylinder assembly 121 establishes a positive clamping force on the log 44 by clamp 132. The related control of the travel rates of cylinder assemblies 130 and 121 provides for fast lowering of the saw to the log and control of the saw cut rate. Gravity actuation of clamps 134 clamp the block end of the log. The continued lowering of the saw ladder 116 by the hydraulic cylinder 130 forces the saw to cut through the log 44 separating block 52 from the log.

When the saw ladder 116 reaches the lowermost position of its travel an electrical circuit is energized causing the hydraulic pressure to be directed to reverse the travel of saw ladder 116 to remove the saw 50 from the cut. Simultaneously the infeed conveyor 46 is reversed a pre-established distance removing the log 44 from contact with the saw during return to the normal upper position.

When the saw reaches its raised position raising the clamps from the log 44 and the block 52, the block 52 is positioned on block support 54 FIG. 23. Hydraulic pressure is automatically applied to the piston rod end of cylinder 162 lowering the block support 54 to the lower broken line position, FIG. 23, permitting the block 52 to roll by gravity across skids 168 and into lower center pan 180. Hydraulic pressure is then reversed from the piston rod end of cylinder 162 to the piston end raising the block support 54 to its normal position and initiating the next cycle of longitudinal travel of the log 44 against the log stop 48.

Simultaneous with the return of the block support 54 to its normal position lower and upper centering pan cylinders 194 and 206 are supplied with hydraulic pressure causing the lower centering pan 180 to raise and the upper centering pan 196 to lower, bringing the upper centering pan into contact with the block 52 centering the block with the splitter blade assembly 58. Hydraulic pressure to the cylinders 194 and 206 is regulated to provide the desired squeeze or grip on the block 52. With the block centered hydraulic pressure is supplied to the ram cylinder 62, FIG. 15, forcing the block 52 through the splitter blade assembly 58 and onto the belt conveyor 64, FIG. 1. Hydraulic pressure to the cylinder 62 is then reversed retracting the ram 60 and returning the centering pans to receive the next block from the block support 54.

In the event the block 52 is judged to be unacceptable for split firewood the operator may over-ride the sequence of lowering block support 54 by depressing an over-ride button of control station 42 causing valves to release the hydraulic pressure in the piston rod end of cylinder 164 and to pressurize the piston end of cylinder 164 raising the block support 54 to the elevated position rejecting the block onto skid plate 170 and reject conveyor 66.

The remnant end of log 44 may be rejected to the reject conveyor 66 by the operator's actuating a suitable control button providing hydraulic pressure to kicker cylinder 176, FIG. 16, causing the remnant to be discharged onto the reject conveyor 66. The reject conveyor 66 discharges onto belt conveyor 64 where the rejects become intermixed with the split firewood ejected from splitter blade assembly 58.

Packaging operators stationed along the sides of the belt conveyor 64, FIG. 1, remove and package the acceptable split firewood into packages at the packaging stations 70. The reject material is discharged from belt conveyor 64 onto reject elevator 72 for discharge into the skip 74 for later disposal.

The splitter blade assembly 58 is selected based on the diameter of the logs 44 to be processed. Small logs are split with a single blade or with a four-blade splitter, FIG. 38. Large logs are split with a splitter assembly of six or more blades, FIG. 15. For the production of kindling the splitter blade assembly shown in FIG. 32 is employed.

The sequence of events described continues as each log 44 is discharged from the live deck 40 onto the longitudinal conveyor 46. The sequence may be interrupted or modified by the operator by use of suitable control buttons at control station 42.

Having thus described the apparatus of my inventon in preferred embodiments, I claim:

1. Firewood splitting apparatus, comprising:

(a) a frame, (b) block splitter means on the frame, (c) ram means on the frame arranged for axial movement toward and away from the splitter means for moving a block toward the splitter means, and (d) block centering means on the frame comprising upper and lower centering pans arranged to receive a block between them and movable vertically to position the block between the splitter means and the ram means.

2. The apparatus of claim 1 including a fluid pressure cylinder engaging each centering pan, and means for metering equal quantities of fluid under pressure to the cylinders.

3. Firewood cutting apparatus, comprising:

(a) a frame, (b) infeed conveyor means on the frame for moving a log between infeed and outfeed ends thereof, (c) block support means adjacent the outfeed end of the infeed conveyor means for supporting a log block, (d) a power saw, (e) saw support means on the frame for moving the saw through a log in a vertical plane between the infeed conveyor means and the block support means, (f) clamp means adjacent the saw for clamping a log to at least one of the infeed conveyor means and block support means, (g) a saw guard enclosing the saw and mounted on the frame for movement with and relative to the saw, (h) saw support power means interengaging the frame and saw support means for moving the saw toward and away from a log, (i) saw guard support means mounted on the saw support means for movement relative thereto, and (j) saw guard support power means interengaging the saw support means and saw guard support means for moving the saw guard relative to the saw.

4. The apparatus of claim 3 wherein the saw support power means and the saw guard support power means are arranged to move the saw toward a log at a predetermined speed and through the log at a speed less than said predetermined speed.

5. Firewood cutting and splitting apparatus, comprising:

(a) a frame, (b) infeed conveyor means on the frame for moving a log between infeed and outfeed ends thereof, (c) block support means adjacent the outfeed end of the infeed conveyor means for supporting a log block, (d) a power saw, (e) saw support means on the frame for moving the saw through a log in a vertical plane between the infeed conveyor means and the block support means, (f) clamp means adjacent the saw for clamping a log to at least one of the infeed conveyor means and block support means, (g) mounting means on the frame for mounting the block support means for movement between a position supporting a block during cutting of a log by the saw and a position discharging the block cut from the log, (h) block splitter means on the frame, (i) ram means on the frame arranged for axial movement toward and away from the splitter means for moving a block toward the splitter means, and (j) block centering means on the frame arranged to receive a block discharged from the block support means and to position the block between the splitter means and ram means, (k) the block centering means comprising upper and lower centering pans arranged to receive a block between them and movable vertically to position the block between the splitter means and ram means.

6. The apparatus of claim 5 including a fluid pressure cylinder engaging each centering pan, and means for metering equal quantities of fluid under pressure to the cylinders.

7. Firewood cutting and splitting apparatus, comprising:

(a) a frame, (b) infeed conveyor means on the frame for moving a log between infeed and outfeed ends thereof, (c) block support means adjacent the outfeed end of the infeed conveyor means for supporting a log block, (d) a power saw, (e) saw support means on the frame for moving the saw through a log in a vertical plane between the infeed conveyor means and the block support means, (f) clamp means adjacent the saw for clamping a log to at least one of the infeed conveyor means and block support means, (g) mounting means on the frame for mounting the block support means for movement between a position supporting a block during cutting of a log by the saw and a position discharging the block cut from the log, (h) block splitter means on the frame, (i) ram means on the frame arranged for axial movement toward and away from the splitter means for moving a block toward the splitter means, (j) block centering means on the frame arranged to receive a block discharged from the block support means and to position the block between the splitter means and ram means, (k) a saw guard enclosing the saw and mounted on the frame for movement with and relative to the saw, (l) saw support power means interengaging the frame and saw support means for moving the saw toward and away from a log, (m) saw guard support means mounted on the frame support means for movement relative thereto, and (n) saw guard support power means interengaging the saw support means and saw guard support means for moving the saw guard relative to the saw.

8. The apparatus of claim 7 wherein the saw support power means and the saw guard support power means are arranged to move the saw toward a log at a predetermined speed and through the log at a speed less than said predetermined speed.

9. Firewood cutting apparatus, comprising:

(a) a frame, (b) infeed conveyor means on the frame for moving a log between infeed and outfeed ends thereof, (c) block support means adjacent the outfeed end of the infeed conveyor means for supporting a log block, (d) a power saw, (e) saw support means on the frame for moving the saw through a log in a vertical plane between the infeed conveyor means and the block support means, (f) clamp means adjacent the saw for clamping a log to at least one of the infeed conveyor means and block support means, and (g) a saw guard enclosing the saw and mounted on the frame for movement with and relative to the saw, (h) the clamp means including gravity-actuated clamp jaw means on the outfeed side of the saw guard for clamping a block to the block support means.

10. Firewood cutting apparatus, comprising:

(a) a frame, (b) infeed conveyor means on the frame for moving a log between infeed and outfeed ends thereof, (c) block support means adjacent the outfeed of the infeed conveyor means for supporting a log block, (d) a power saw (e) saw support means on the frame for moving the saw through a log in a vertical plane between the infeed conveyor means and the block support means, (f) clamp means adjacent the saw for clamping a log to at least one of the infeed conveyor means and block support means, and (g) a saw guard enclosing the saw and mounted on the frame for movement with and relative to the saw, (h) the clamp means including hinged clamp jaw means on the infeed side of the saw guard for clamping a log to the infeed conveyor means, and gravity-actuated clamp jaw means on the outfeed side of the saw guard for clamping a block to the block support means.

11. Firewood cutting apparatus, comprising:

(a) a frame, (b) infeed conveyor means on the frame for moving a log between infeed and outfeed ends thereof, (c) block support means adjacent the outfeed end of the infeed conveyor means for supporting a log block, (d) a power saw, (e) saw support means on the frame for moving the saw through a log in a vertical plane between the infeed conveyor means and the block support means, (f) clamp means adjacent the saw for clamping a log to at least one of the infeed conveyor means and block support means, (g) longitudinally adjustable stop means on the frame for adjusting the length of a block to be cut from a log, (h) mounting means on the frame for mounting the block support means for movement between a position supporting a block during cutting if a log by the saw and a position discharging the block cut from the log, and a position rejecting a log remnant, (i) a saw guard enclosing the saw and mounted on the frame for movement with and relative to the saw, (j) saw support power means interengaging the frame and the saw support means for moving the saw toward and away from a log, (k) saw guard support means mounted on the saw support means for movement relative thereto, and (l) saw guard support power means interengaging the saw support means and saw guard support means for moving the saw guard relative to the saw, (m) the saw support power means and the saw guard support power means being arranged to move the saw toward a log at a predetermined speed and through the log at a speed less than said predetermined speed, (n) the clamp means including hinged clamp jaw means on the infeed side of the saw guard for clamping a log to the infeed conveyor means, and gravity actuated clamp jaw means on the outfeed side of the saw guard for clamping a block to the block support means.

12. Firewood cutting and splitting apparatus, comprising:

(a) a frame, (b) infeed conveyor means on the frame for moving a log between infeed and outfeed ends thereof, (c) block support means adjacent the outfeed end of the infeed conveyor means for supporting a log block, (d) a power saw, (e) saw support means on the frame for moving the saw through a log in a vertical plane between the infeed conveyor means and the block support means, (f) clamp means adjacent the saw for clamping a log to at least one of the infeed conveyor means and block support means, (g) mounting means on the frame for mounting the block support means for movement between a position supporting a block during cutting of a log by the saw and a position discharging the block cut from the log, (h) block splitter means on the frame, (i) ram means on the frame arranged for axial movement toward and away from the splitter means for moving a block toward the splitter means, (j) block centering means on the frame arranged to receive a block discharged from the block support means and to position the block between the splitter means and ram means, and (k) a saw guard enclosing the saw and mounted on the frame for movement with and relative to the saw, the clamp means including hinged clamp jaw means on the infeed side of the saw guard for clamping a log to the infeed conveyor means, and gravity actuated clamp jaw means on the outfeed side of the saw guard for clamping a block to the block support means.

13. Firewood cutting and splitting apparatus, comprising:

(a) a frame, (b) infeed conveyor means on the frame for moving a log between infeed and outfeed ends thereof, (c) block support means adjacent the outfeed end of the infeed conveyor means for supporting a log block, (d) a power saw, (e) saw support means on the frame for moving the saw through a log in a vertical plane between the infeed conveyor means and the block support means, (f) clamp means adjacent the saw for clamping a log to at least one of the infeed conveyor means and block support means, (g) mounting means on the frame for mounting the block support means for movement between a position supporting a block during cutting of a log by the saw, a position discharging the block cut from the log, and a position rejecting a log remnant, (h) block splitter means on the frame, (i) ram means on the frame arranged for axial movement toward and away from the splitter means for moving a block toward the splitter means, and (j) block centering means on the frame arranged to receive a block discharged from the block support means and to position the block between the splitter means and ram means.

14. Firewood cutting and splitting apparatus, comprising:

(a) a frame, (b) infeed conveyor means on the frame for moving a log between infeed and outfeed ends thereof, (c) block support means adjacent the outfeed end of the infeed conveyor means for supporting a log block, (d) a power saw, (e) saw support means on the frame for moving the saw through a log in a vertical plane between the infeed conveyor means and the block support means, (f) clamp means adjacent the saw for clamping a log to at least one of the infeed conveyor means and block support means, (g) mounting means on the frame for mounting the block support means for movement between a position supporting a block during cutting of a log by the saw, a position discharging the block cut from the log, and a position rejecting the log remnant, (h) block splitter means on the frame, (i) ram means on the frame arranged for axial movement toward and away from the splitter means for moving a block toward the splitter means, (j) block centering means on the frame arranged to receive a block discharged from the block support means and to position the block between the splitter means and ram means, (k) longitudinally adjustable stop means on the frame for adjusting the length of a block to be cut from a log, (l) a saw guard enclosing the saw and mounted on the frame for movement with and relative to the saw, (m) saw support power means interengaging the frame and saw support means for moving the saw toward and away from a log, (n) saw guard support means mounted on the saw support means for movement relative thereto, and (o) saw guard support power means interengaging the saw support means and saw guard support means for moving the saw guard relative to the saw, (p) the saw support power means and the saw guard support power means being arranged to move the saw toward a log at a predetermined speed and through the log at a speed less than said predetermined speed, (q) the clamp means including hinged clamp jaw means on the infeed side of the saw guard for clamping a log to the infeed conveyor means, and gravity actuated clamp jaw means on the outfeed side of the saw guard for clamping a block to the block support means, (r) the block centering means comprising upper and lower centering pans arranged to receive a block between them and movable vertically to position the block between the splitter means and ram means.

* * * * *